US009428927B2

(12) United States Patent
Vale et al.

(10) Patent No.: US 9,428,927 B2
(45) Date of Patent: Aug. 30, 2016

(54) PRE-FABRICATED MODULE FOR MULTI-DWELLING HOUSING UNITS

(71) Applicants: Donald Vale, Kirkland, WA (US); Sean Byrne, Oak Harbor, WA (US)

(72) Inventors: Donald Vale, Kirkland, WA (US); Sean Byrne, Oak Harbor, WA (US)

( * ) Notice: Subject to any disclaimer, the term of this patent is extended or adjusted under 35 U.S.C. 154(b) by 0 days.

(21) Appl. No.: 14/789,939

(22) Filed: Jul. 1, 2015

(65) Prior Publication Data

US 2016/0002938 A1 Jan. 7, 2016

Related U.S. Application Data

(60) Provisional application No. 62/019,544, filed on Jul. 1, 2014.

(51) Int. Cl.
*E04H 1/00* (2006.01)
*E04B 1/348* (2006.01)

(52) U.S. Cl.
CPC ..... *E04H 1/005* (2013.01); *E04B 1/34869* (2013.01)

(58) Field of Classification Search
CPC ..... E04H 1/005; E04B 1/348
See application file for complete search history.

(56) References Cited

U.S. PATENT DOCUMENTS 5,103,604 A * 4/1992 Teron ..... E04B 1/34861 52/126.3
6,308,465 B1 * 10/2001 Galloway ..... E03C 1/01 137/360
7,549,606 B2 * 6/2009 Quan ..... B64D 11/02 244/118.5
2001/0047628 A1 * 12/2001 Mouton ..... E04B 1/3483 52/144
2002/0100228 A1 * 8/2002 Yoder ..... B29C 47/0019 52/80.1
2002/0178497 A1 * 12/2002 Thurston ..... A47C 17/84 5/10.1
2004/0163327 A1 * 8/2004 Cash ..... A47B 91/002 52/27
2005/0108957 A1 * 5/2005 Quesada ..... E04H 1/1266 52/143
2005/0188632 A1 * 9/2005 Rosen ..... E04C 2/521 52/220.2
2005/0241062 A1 * 11/2005 Quan ..... E03C 1/01 4/664
2006/0238085 A1 * 10/2006 Greenberg ..... A47B 51/00 312/306
2007/0130841 A1 * 6/2007 Bays ..... E04B 1/02 52/3
2010/0229472 A1 * 9/2010 Malpas ..... E04F 17/08 52/79.1
2011/0179721 A1 * 7/2011 Barry ..... E04B 1/34869 52/79.1
2012/0266546 A1 * 10/2012 Gyory ..... E04B 1/3444 52/126.1
2013/0014451 A1 * 1/2013 Russell ..... E04B 1/34869 52/79.1
2014/0351014 A1 * 11/2014 Lopez ..... G06Q 50/06 705/7.31

FOREIGN PATENT DOCUMENTS

GB 2427417 A * 12/2006 ..... E04B 1/34869

* cited by examiner

*Primary Examiner* — Jeanette E Chapman

(57) ABSTRACT

A pre-fabricated module for multi-dwelling housing units decreases the building time to of the multi-dwelling housing units such as apartment, hotels, and condominiums. The pre-fabricated module is an amenities module which is inserted into a housing unit within the multi-dwelling housing units. Through a plurality of quick-connect couplings and a quick-connect electrical coupling the amenities module accesses a water source, a sewage outlet, and an electrical source from the housing unit in order to provide functional amenities to a tenant. The amenities module includes a kitchen and a bathroom mounted within an enclosure allowing the tenant to cook and maintain hygiene.

18 Claims, 11 Drawing Sheets

PRE-FABRICATED MODULE FOR MULTI-DWELLING HOUSING UNITS

The current application claims a priority to the U.S. Provisional Patent application Ser. No. 62/019,544 filed on Jul. 1, 2014.

FIELD OF THE INVENTION

The present invention relates generally to amenities modules for multi-dwelling housing units. More specifically, the present invention relates to a pre-fabricated module to rapidly install kitchen and bathroom amenities into multi-dwelling housing units.

BACKGROUND OF THE INVENTION

Traditionally, construction of multi-dwelling housing units, including apartments, condominiums, and hotels, can be costly, time consuming and difficult to maintain quality control. Various tradesmen are required to be on site to provide services to ensure an appropriate quality control when crafting a living space. Sometimes due to miscommunication or misreading of blueprints, mistakes can be made with where the utilities align between floors or for the layout of the floors. Thus, leading to time delays and monetary setbacks for construction. These traditional multi-dwelling housing units are typically built onsite such that the plumbing and heating ventilation and cooling systems determine the arrangement of the various floor plans for dwellings throughout the building.

The present invention is a pre-fabricated module for multi-dwelling housing units designed which allows for flexible floor plans, as well as for consistent access points for utilities. The present invention is able to be inserted into dwellings and provides the dwelling with several amenities including a kitchen, a bathroom, and in some embodiments a sleeping space. The modular nature of the present invention allows for units to be pre-constructed and inserted into a multi-dwelling housing unit as the rooms are being constructed to save time and money in comparison to onsite construction.

DETAIL DESCRIPTIONS OF THE INVENTION

All illustrations of the drawings are for the purpose of describing selected versions of the present invention and are not intended to limit the scope of the present invention.

The present invention is a pre-fabricated module for multi-dwelling housing units. The present invention allows for a decreased construction time for the multi-dwelling housing units by providing the pre-fabricated module which can be readily installed into the multi-dwelling housing units. The prefabricated module is constructed offsite. When the prefabricated module is installed, the prefabricated module is simply inserted into the multi-dwelling housing units and connected to the multi-dwelling housing unit through utility connections.

Figure 1:
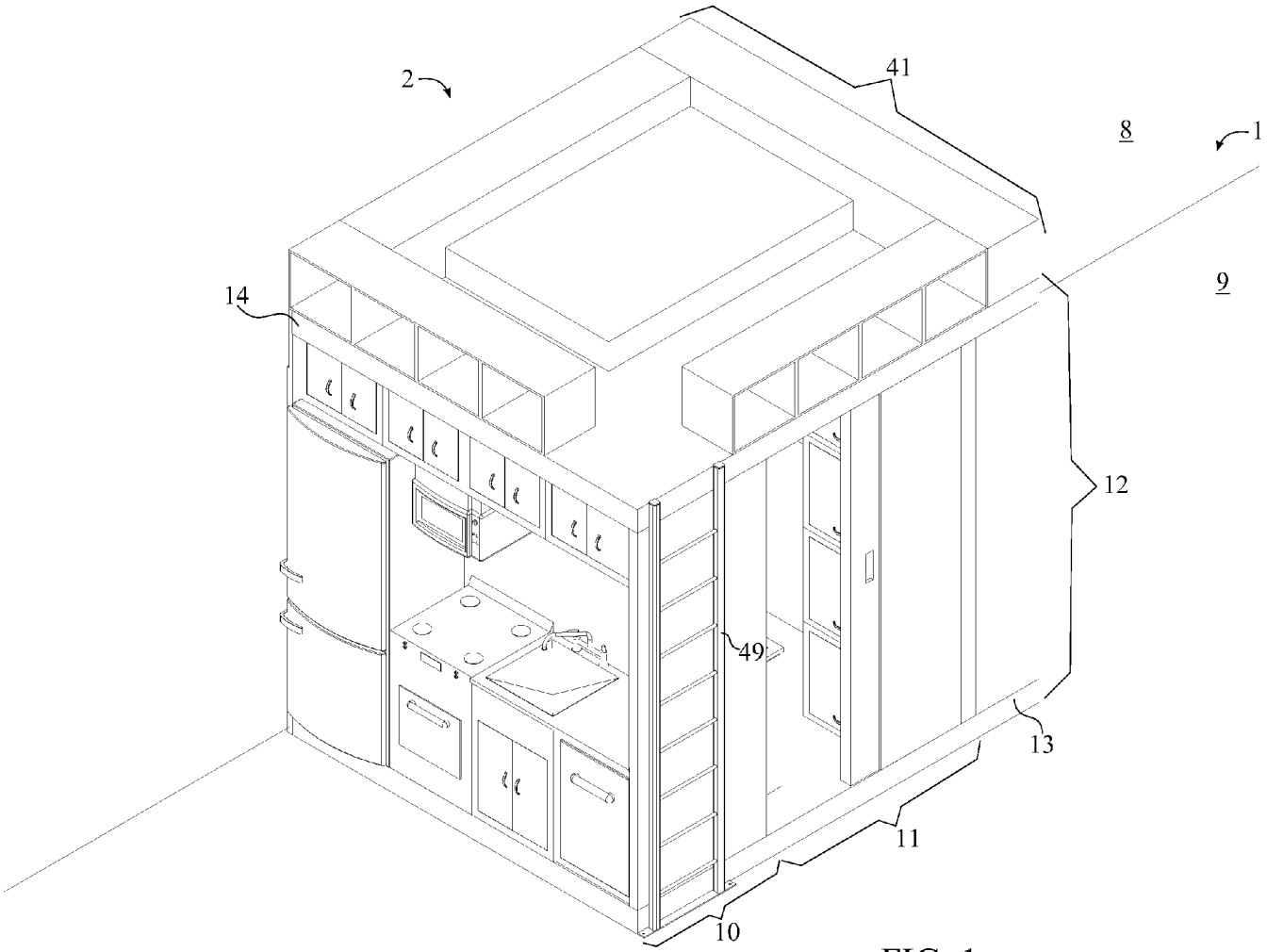
FIG. 1 is a perspective view of present invention where the amenities module is mounted to the housing unit.
Figure 2:
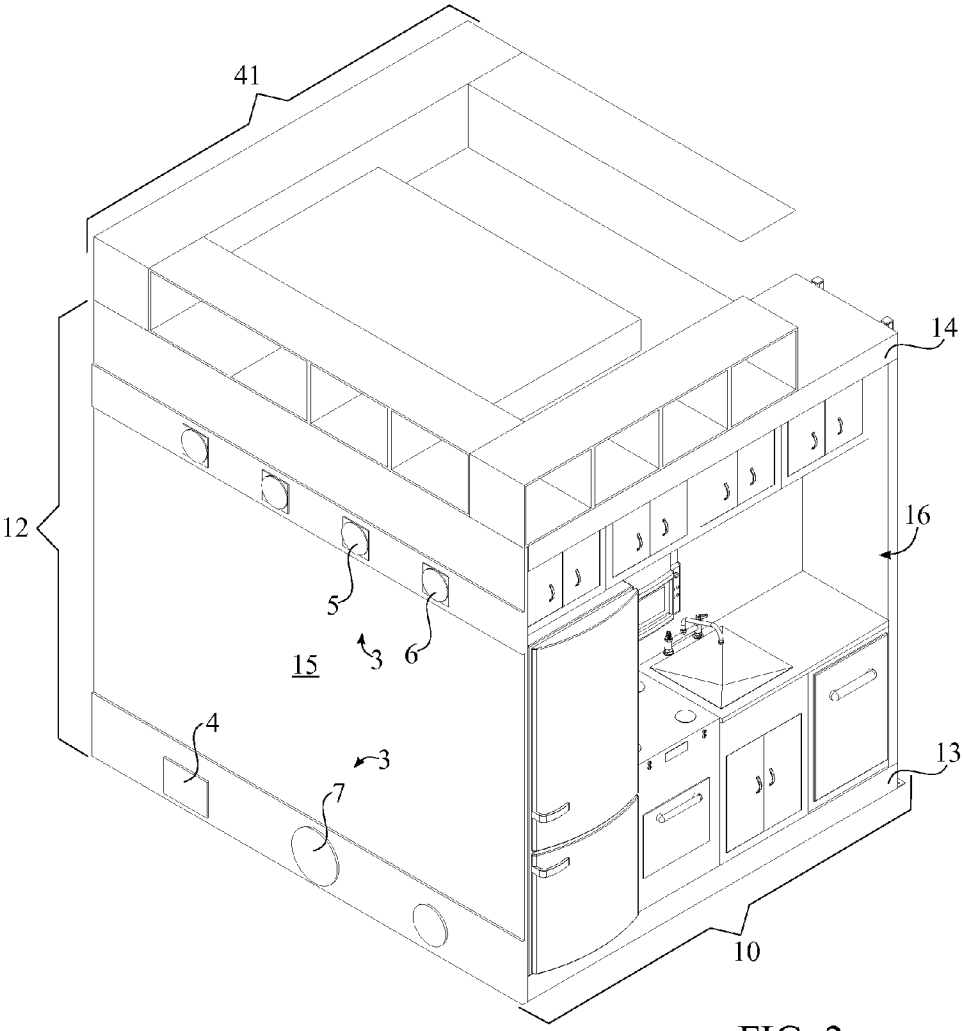
FIG. 2 is a rear perspective view of the amenities module.
Figure 7:
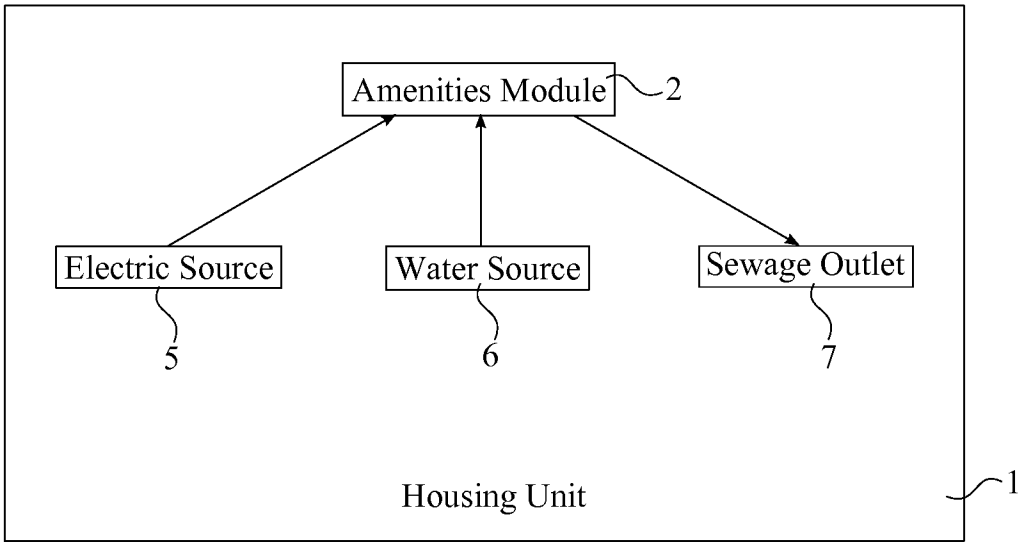
FIG. 7 is a block diagram detailing the housing unit of the present invention.

In accordance to FIG. 1 and FIG. 2, the present invention comprises a housing unit 1, an amenities module 2, a plurality of quick-connect couplings 3, and a quick-connect electrical coupling 4. The housing unit 1 is a single unit within an apartment, a hotel, a condominium, or another similar housing building. The amenities module 2 provides the tenant with access to utilities, including water, electric, etc., as well as other amenities for cooking, managing personal hygiene, sleeping, and storage. The housing unit 1 comprises an electric source 5, a water source 6, and a sewage outlet 7, shown in FIG. 7, as well as an at least one wall 8, and a floor 9. The electric source 5 is an electric access point to provide the amenities module 2 with electricity from a local power grid. The water source 6 provides access to clean water throughout the amenities module 2. The sewage outlet 7 allows for the disposal of waste water and other fluid waste into a local sewage system. The at least one wall 8 is a vertical structural support, which supports other housing units above the housing unit 1 as well as dividing adjacent housing units on the same level. The floor 9 is a horizontal structural support which supports the amenities module 2 as well as additional furniture a tenant places into the housing unit 1. The plurality of quick-connect couplings 3 and the quick-connect electrical coupling 4 allow the amenities module 2 to be rapidly connected to the electric source 5, the water source 6, and the sewage outlet 7 of the housing unit 1.

The amenities module 2 comprises a kitchen 10, a bathroom 11, and an enclosure 12. The kitchen 10 allows access to cooking, refrigeration, and storage appliances. The bathroom 11 provides access to bathing, disposing of human waste, and other hygiene facilities. The enclosure 12 delineates the physical boundaries of the amenities module 2. The enclosure 12 comprises a base 13, a ceiling 14, at least one solid lateral face 15, and at least one open lateral face 16, as shown in FIG. 2. The base 13 is horizontal a support structure which the kitchen 10 and the bathroom 11 are supported. The at least one solid lateral face 15 supports the ceiling 14 and allows for the plurality of quick-connect couplings 3 and the quick-connect electrical coupling 4 to be housed within. The ceiling 14 is connected to the at least one solid lateral face 15 and is positioned opposite to the base 13. The ceiling 14 provides space for the housing of lighting and ventilation as well as supporting the weight of storage and/or tenant in some embodiments. The kitchen 10 is peripherally positioned to the at least one open lateral face 16, between the base 13 and the ceiling 14, such that the kitchen 10 is easily accessible to tenants from within the housing unit 1.

Figure 4:
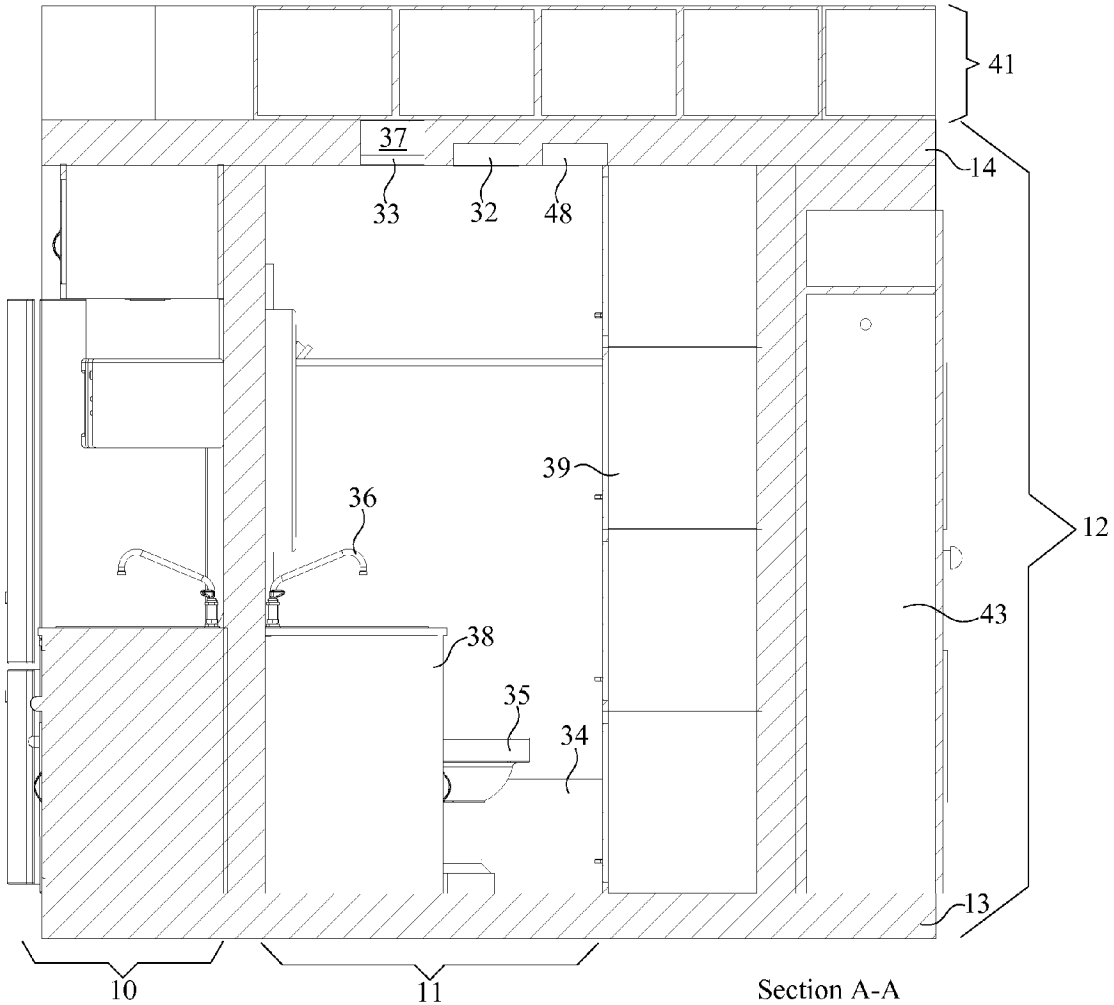
FIG. 4 is a front view of the amenities module through the line A-A in FIG. 3.
Figure 5:
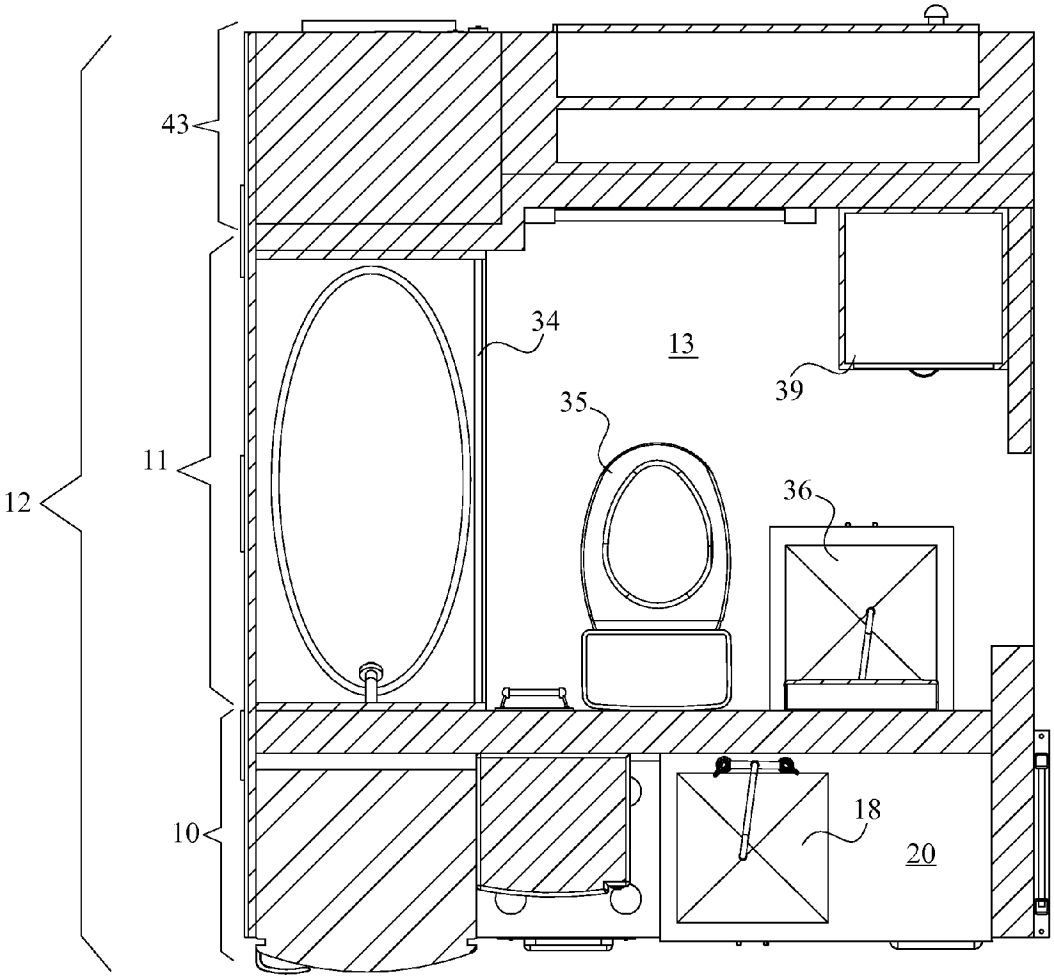
FIG. 5 is a top view of the amenities module through the line B-B in FIG. 3, detailing the bathroom of the present invention.

The bathroom 11 is internally positioned to the enclosure 12, between the base 13 and the ceiling 14, to provide privacy to the tenant during use, as shown in FIG. 4 and FIG. 5.

Further, the amenities module 2 is structurally connected to the housing unit 1 through the at least one solid lateral face 15. The amenities module 2 is connected to the water source 6 and the sewage outlet 7 through the plurality of quick-connect couplings 3. The amenities module 2 is electrically connected to the electric source 5 through the quick-connect electrical coupling 4. The plurality of quick-connect couplings 3 comprises a water inlet coupling 28 and a sewage coupling 29 which respectively connect the amenities module 2 to the water source 6 and the sewage outlet 7, respectively.

Figure 3:
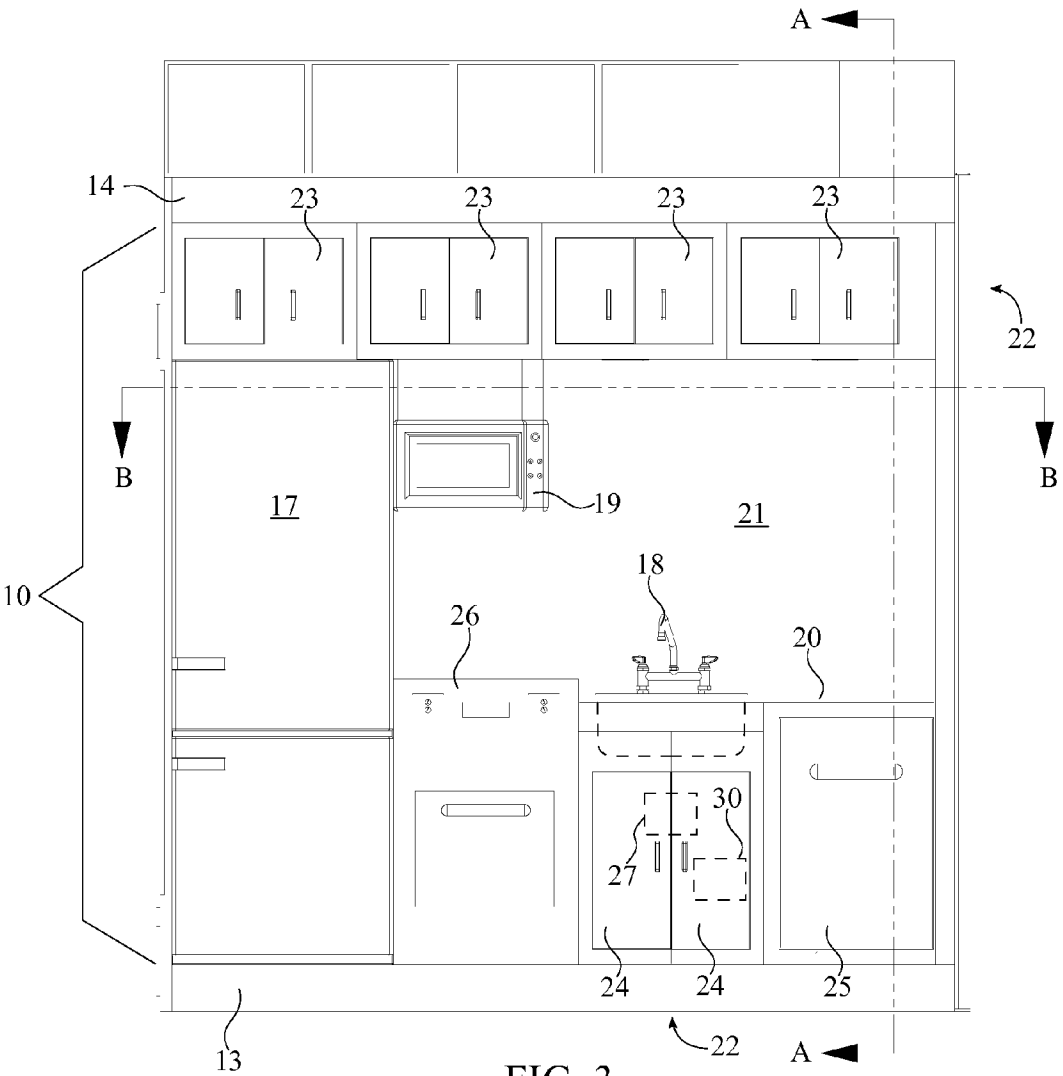
FIG. 3 is a side view of the amenities module detailing the preferred embodiment of the kitchen.

In accordance to the preferred embodiment shown in FIG. 3, the kitchen 10 comprises a refrigerator 17, a kitchen sink 18, a microwave 19, a counter 20, a backing 21, and a plurality of cabinets 22. The refrigerator 17 keeps food at a low temperature slightly above freezing in order to preserve the food longer. The kitchen sink 18 allows for water access and waste water disposal. The microwave 19 allows the user to cook a plurality of food quickly and efficiently. The counter 20 is a support which allows the user to prepare food and support small appliances, such as toasters, coffee makers, blenders, etc. The backing 21 is a vertical support which the plurality of cabinets 22 is supported. The backing 21 is perpendicularly mounted to the base 13. The plurality of cabinets 22 allows for storage of utensils, cookware, and tableware. The plurality of cabinets 22 comprises a plurality of upper cabinets 23 and a plurality of lower cabinets 24. The plurality of upper cabinets 23 allows for overhead storage of generally light weight items, while the plurality of lower cabinets 24 allows for storage of heavier items.

In accordance to the preferred embodiment of the kitchen 10, the plurality of upper cabinets 23 is mounted to the backing 21, adjacently positioned to the ceiling 14, in order to secure the plurality of upper cabinets 23 to the amenities module 2. The plurality of lower cabinets 24 is adjacently mounted to the backing 21 and the base 13 to secure the plurality of lower cabinets 24 within the amenities module 2. The counter 20 is positioned between the plurality of lower cabinets 24 and the plurality of upper cabinets 23 and adjacently mounted to the plurality of lower cabinets 24 in order to provide a stable surface for preparing food and supporting small appliances. The kitchen sink 18 is integrated into the counter 20 in order to allow for sufficient space which tableware and cookware may be placed for cleaning. The microwave 19 is mounted to the plurality of upper cabinets 23, opposite of the ceiling 14, in order to secure the microwave 19, as well as being suspended above the counter 20 allowing for unhindered space on the counter 20.

Figure 8:
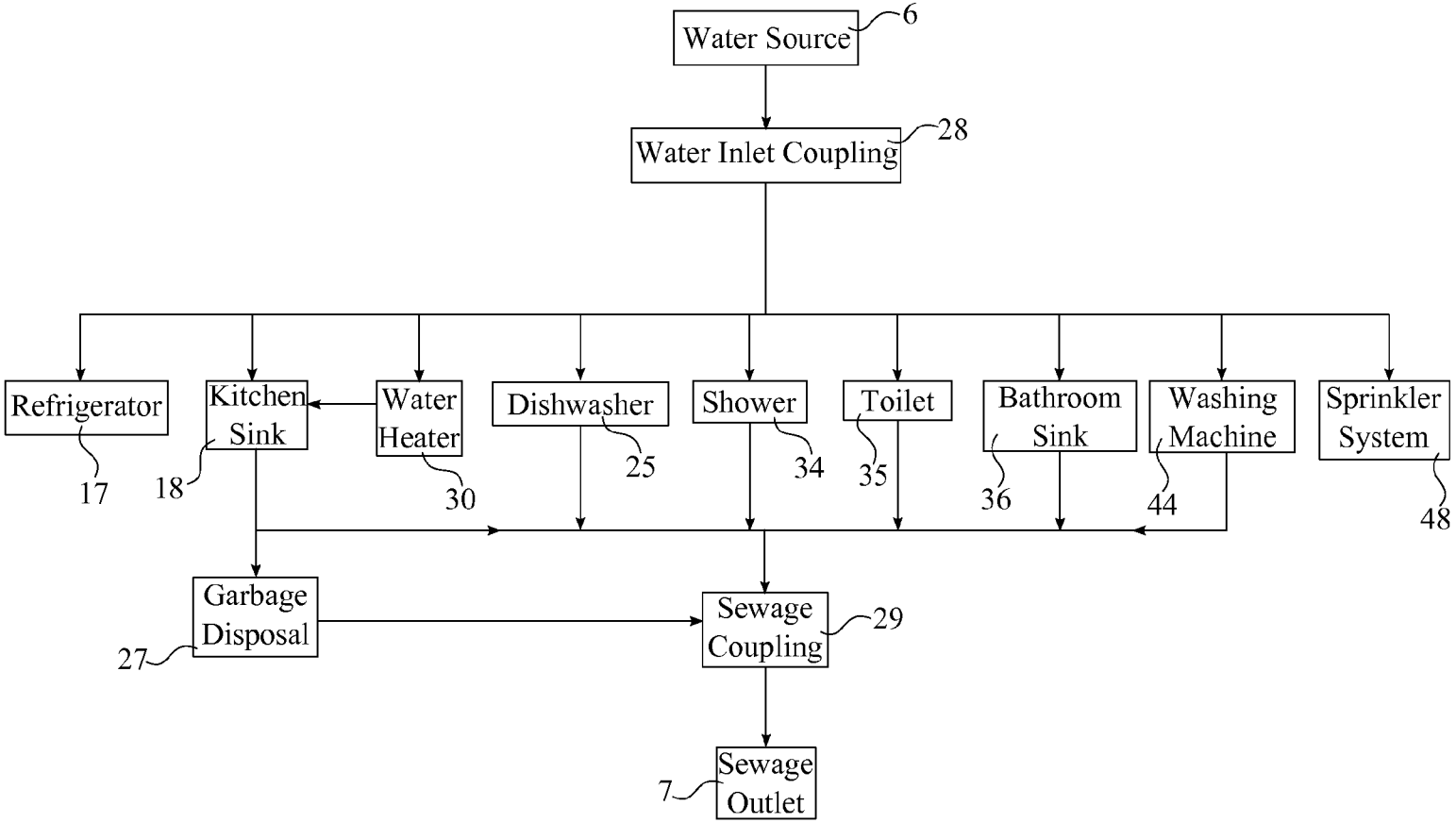
FIG. 8 is a block diagram detailing the general flow of water through the present invention.

In order to have water flowing to the refrigerator 17 and the kitchen sink 18 for operation, the water source 6 is in fluid communication with the refrigerator 17 and the kitchen sink 18 through the water inlet coupling 28, in accordance to FIG. 8. Thus, allowing the refrigerator 17 to produce ice or dispense water and allowing the kitchen sink 18 to dispense water such that the tenant is able to wash their hands and have easy access to water to prepare food. The kitchen sink 18 is in fluid communication with the sewage outlet 7 through the sewage coupling 29, in order to remove excess and waste water. Similarly, the refrigerator 17 and the microwave 19 require electricity to operate; therefore, the refrigerator 17 and the microwave 19 are electrically connected to the electric source 5 through the quick-connect electrical coupling 4 to provide the refrigerator 17 and the microwave 19 with electricity, as detailed in FIG. 9. In some embodiments of the present invention, waste water is filtered through a filtration unit and recycled in order to conserve fresh water.

Figure 9:
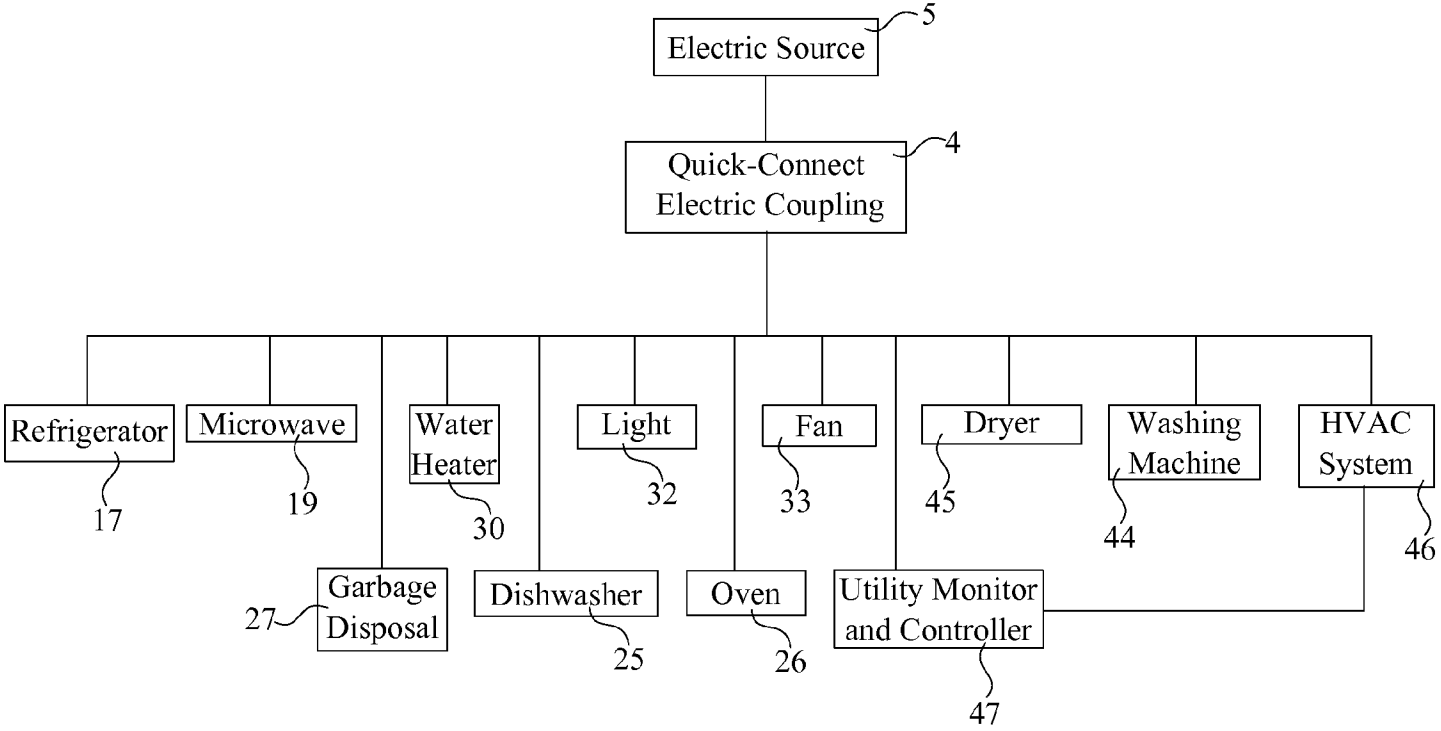
FIG. 9 is a block diagram detailing the electrical connections of the present invention.

In accordance to FIG. 3, the preferred embodiment of the kitchen 10 further comprises a dishwasher 25. The dishwasher 25 allows the user to clean tableware and cookware quickly and efficiently. The dishwasher 25 is mounted to the base 13 and positioned between the base 13 and the counter 20 to secure the dishwasher 25 to the amenities module 2 for convenient access. As shown in FIG. 8, the water source 6 is in fluid communication with the dishwasher 25 through the water inlet coupling 28 in order for the dishwasher 25 to draw water for washing and rinsing tableware and cookware. The dishwasher 25 is also in fluid communication with the sewage outlet 7 through the sewage coupling 29 in order to discharge the waste water from dishwasher 25. The dishwasher 25 is electrically connected to the electric source 5 through the quick-connect electrical coupling 4 in order to power a pump within the dishwasher 25 as well as a control panel for operation of the dishwasher 25 as shown in FIG. 9.

In the preferred embodiment of the kitchen 10 and FIG. 3, the kitchen 10 further comprises an oven 26. The oven 26 allows the tenant to heat and cook food for consumption. The oven 26 is mounted to the base 13 and positioned between the base 13 and the counter 20, in order to secure the oven 26 within the amenities module 2 for convenient access. In accordance to FIG. 9, the oven 26 is electrically connected to the electric source 5 through the quick-connect electrical coupling 4 in order to power a control panel for operation, as well as a heating element within electric models. In some embodiments, the present invention comprises a natural gas source and a quick-connect natural gas coupler. Then the oven 26 is in fluid communication to the natural gas source through the quick-connect natural gas coupler in order to receive natural gas for operation of the natural gas model.

In the preferred embodiment of the kitchen 10 and FIG. 3, the kitchen 10 further comprises a garbage disposal 27. The garbage disposal 27 grinds food waste into particles which are more readily disposed through the sewage system. The garbage disposal 27 is mounted within a cabinet of the plurality of lower cabinets 24 and positioned in between the kitchen sink 18 and the base 13. As shown in FIG. 8, the kitchen sink 18 is in fluid communication with the garbage disposal 27 such that the waste water and food waste flow from the kitchen sink 18 into the garbage disposal 27. The garbage disposal 27 is in fluid communication with the sewage outlet 7 through the sewage coupling 29, where the waste water and food waste are discharged into the local sewage system. Thus, the kitchen sink 18 is in fluid communication with the sewage outlet 7 through the garbage disposal 27. The garbage disposal 27 is electrically connected to the electric source 5 through the quick-connect electrical coupling 4 in order to provide electricity to the garbage disposal 27, in accordance to FIG. 9.

In the preferred embodiment of the kitchen 10, the kitchen 10 further comprises a water heater 30, as detailed in FIG. 3. The water heater 30 can heat water on demand as the kitchen sink 18 is dispensing water to save energy in comparison to having a hot water tank which stores water at a particular temperature at all times. The water heater 30 is mounted within a cabinet of the plurality of lower cabinets 24 and positioned between the kitchen sink 18 and the base 13, such that it is hidden by the plurality of lower cabinets 24. As shown in FIG. 8, the water source 6 is in fluid communication with the water heater 30 through the water inlet coupling 28. The water heater 30 is in fluid communication with the kitchen sink 18, such that the water outlet of the water heater 30 flows into the kitchen sink 18. In accordance to FIG. 9, the water heater 30 is electrically connected to the electric source 5 through the quick-connect electrical coupling 4 in order to provide electricity for a heating element that transfers heat into water passing through the water heater 30.

Figure 10:
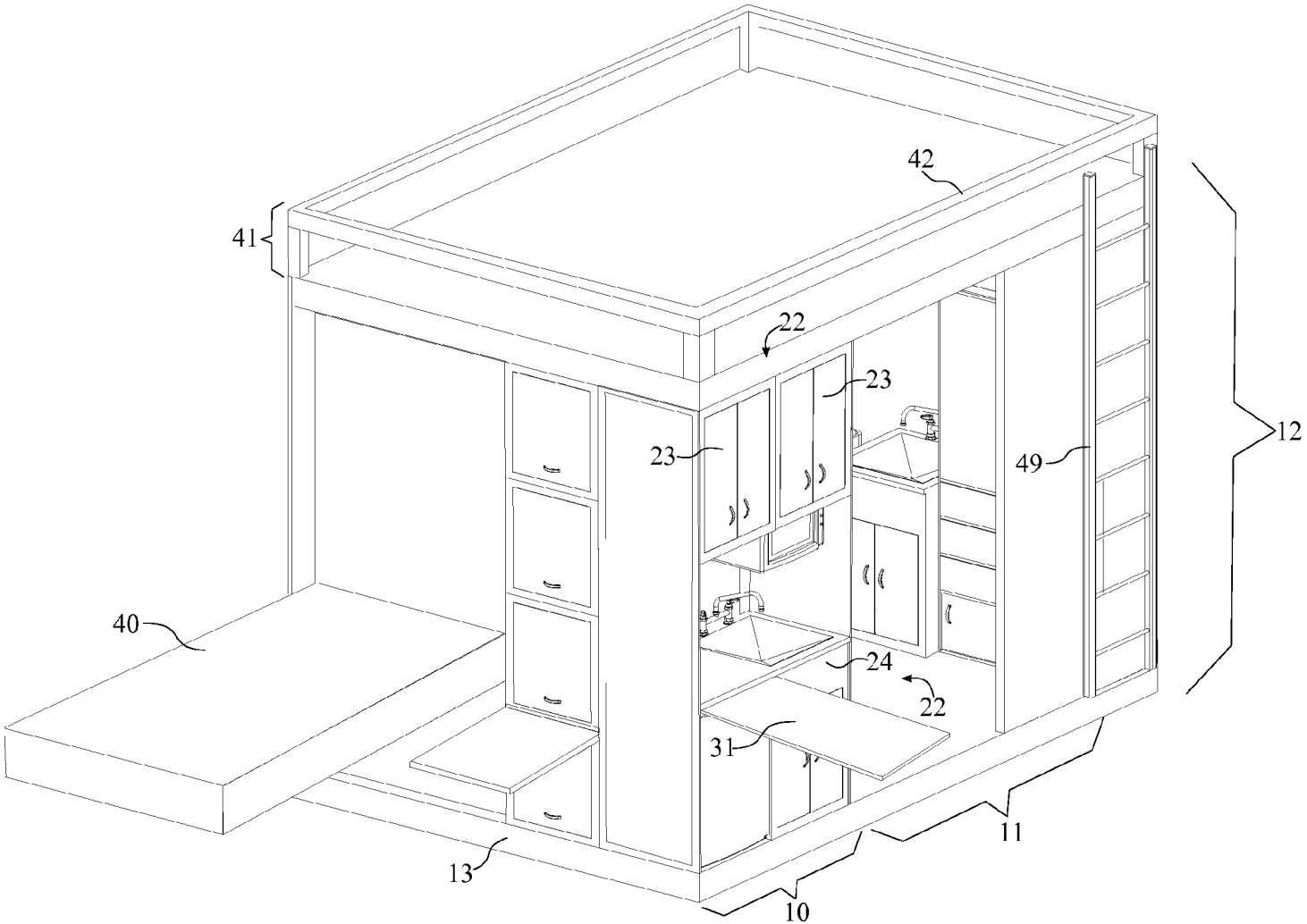
FIG. 10 is a perspective view for an alternate embodiment of the present invention including a fold-down bed, a hide-away table, and a safety railing.

In accordance to the preferred embodiment of the kitchen 10 and FIG. 10, the kitchen 10 further comprises a hide-away table 31. The hide-away table 31 provides additional counter 20 space for the tenant to prepare meals. The hide-away table 31 is integrated into the plurality of lower cabinets 24. The hide-away table 31 is able to be pulled out from the plurality of lower cabinets 24 for use but hidden within the plurality of lower cabinet when the hide-away table 31 is not in use.

In the simplest embodiment, the kitchen 10 comprises the refrigerator 17, the kitchen sink 18, the microwave 19, the counter 20, the backing 21, and the plurality of cabinets 22. In different embodiments, the present invention further comprises the dishwasher 25, the oven 26, the garbage disposal 27, the water heater 30, the hide-away table 31, and combinations thereof.

In accordance to the preferred embodiment of the present invention, the bathroom 11 comprises a light 32, a fan 33, a shower 34, a toilet 35, a bathroom sink 36, a vent 37, a bathroom sink cabinet 38, and a storage cabinet 39, as shown in FIG. 4 and FIG. 5. The light 32 illuminates the bathroom 11. The fan 33 facilitates air flow through the bathroom 11 and into the vent 37. The shower 34 provides a means for tenants to maintain personal hygiene. The shower 34 is a standing shower; however, in some embodiments, the shower 34 can include a tub such that a tenant can lounge while bathing or easily bathe a child or pet. The toilet 35 allows the tenant to discharge human waste into the local sewage system. The bathroom sink 36 allows the tenant to wash their hands and to facilitate additional personal hygiene. The vent 37 allows for air circulation through the enclosure 12 through implementation of the fan 33. The bathroom sink cabinet 38 supports the bathroom sink 36 and provides a storage space for toiletries. The storage cabinet 39 allows for the storage of linens, larger toiletries, and grooming products.

In accordance to the preferred embodiment of the bathroom 11, the shower 34, the toilet 35, the bathroom sink cabinet 38, and the storage cabinet 39 are mounted to the base 13. The bathroom sink 36 is mounted to the bathroom sink cabinet 38, oppositely positioned to the base 13. Detailed in FIG. 8, the water source 6 is in fluid communication with the shower 34, the toilet 35, and the bathroom sink 36 through the water inlet coupling 28 such that clean water is pumped to the shower 34, the toilet 35, and the bathroom sink 36. The shower 34, the toilet 35 and the bathroom sink 36 are in fluid connection with the sewage outlet 7 through the sewage coupling 29 in order to discharge waste water into the local sewage system.

For efficient air circulation and maximum illumination throughout the bathroom 11, the vent 37, the fan 33 and the light 32 are integrated into the ceiling 14, as shown in FIG. 4. The fan 33 is adjacently mounted to the vent 37 in order to pass air from the bathroom 11 into the vent 37. The light 32 and the fan 33 are electrically connected to the electric source 5 through the quick-connect electrical coupling 4 such that the light 32 and the fan 33 are provided with electricity to illuminate the light 32 and power the fan 33, in accordance to FIG. 9.

In some embodiments of the present invention, the present invention comprises a fold-down bed 40, shown in FIG. 10. The fold-down bed 40 is hingedly and externally mounted to the enclosure 12, adjacent to the base 13. The fold-down bed 40 saves space by being positioned vertically when not in use. However, the fold-down bed 40 can be pulled down such that the fold-down bed 40 is positioned perpendicular to the at least one solid lateral face 15 when the tenant wishes to sleep.

In some embodiments of the present invention, the present invention comprises a loft 41 and a ladder 49 in accordance to FIG. 1 and FIG. 10. The loft 41 is an area suitable for storage or sleeping. The ladder 49 allows the tenant to access the loft 41 easily. The ladder 49 is stored within the enclosure 12 and removed from and placed adjacent to the enclosure 12 for use. The loft 41 externally positioned across the ceiling 14 opposite to the base 13. In some embodiments of the present invention, the present invention comprises a safety railing 42, detailed in FIG. 10. The safety railing 42 is perimetrically mounted about the loft 41 in order to prevent a tenant from falling from the loft 41 while asleep.

Figure 6:
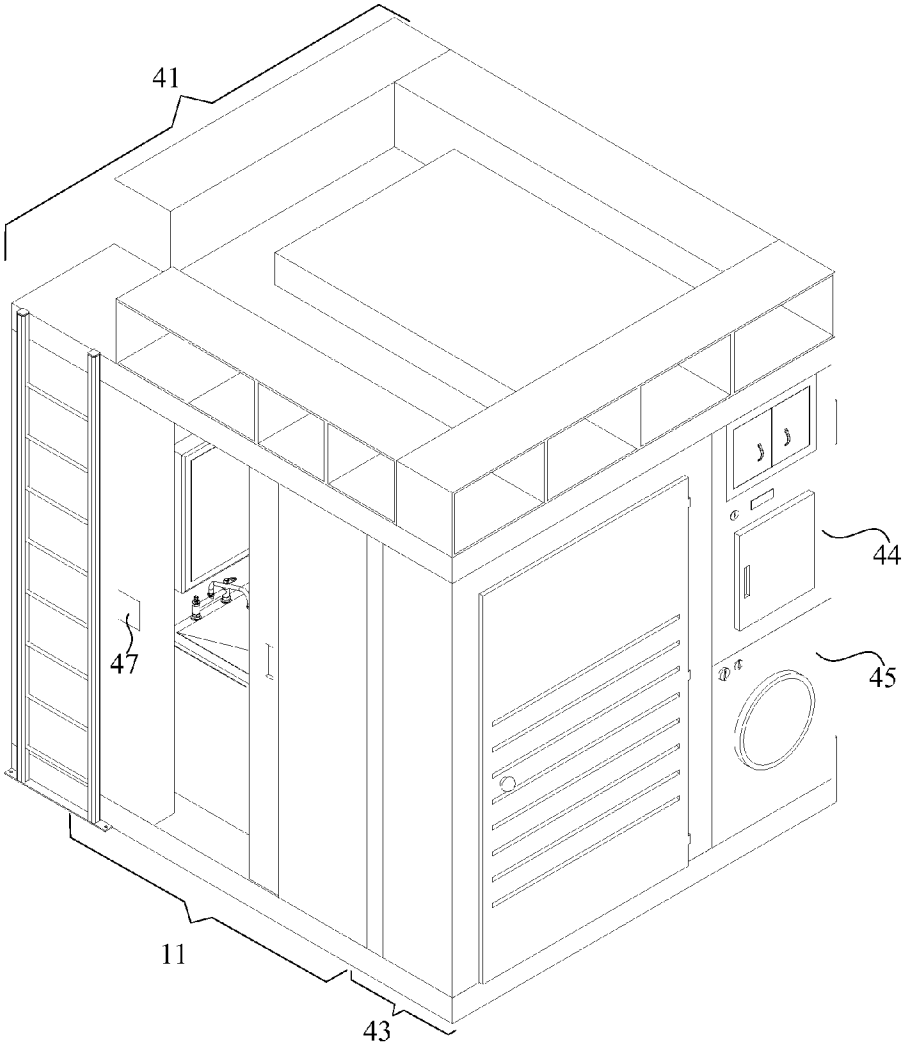
FIG. 6 is a perspective view of the amenities module showing an embodiment including a laundry closet with a washing machine and dryer.

In accordance to some embodiments of the present invention, the present invention further comprises a laundry closet 43 as shown in FIG. 6. The laundry closet 43 comprises a washing machine 44 and a dryer 45. The washing machine 44 allows the tenant to conveniently wash garments within the housing unit 1. The dryer 45 allows tenants to dry garments after being washed or otherwise wet. The laundry closet 43 is integrated into the enclosure 12 between the base 13 and the ceiling 14. The washing machine 44 and dryer 45 are internally positioned within the laundry closet 43 such that they are easily accessible to the tenant for use. In accordance to FIG. 8, the water source 6 is in fluid communication with the washing machine 44 through the water inlet coupling 28 such that clean water is pumped into the washing machine 44 in order to wash the tenant's garments. The washing machine 44 is in fluid communication with the sewage outlet 7 through the sewage coupling 29 such that the waste water from the washing machine 44 is disposed into the local sewage system. As shown in FIG. 9, the washing machine 44 and the dryer 45 are electrically connected to the electric source 5 through the quick-connect electrical coupling 4 in order to provide electricity for the washing machine 44 and the dryer 45 to function.

Figure 11:
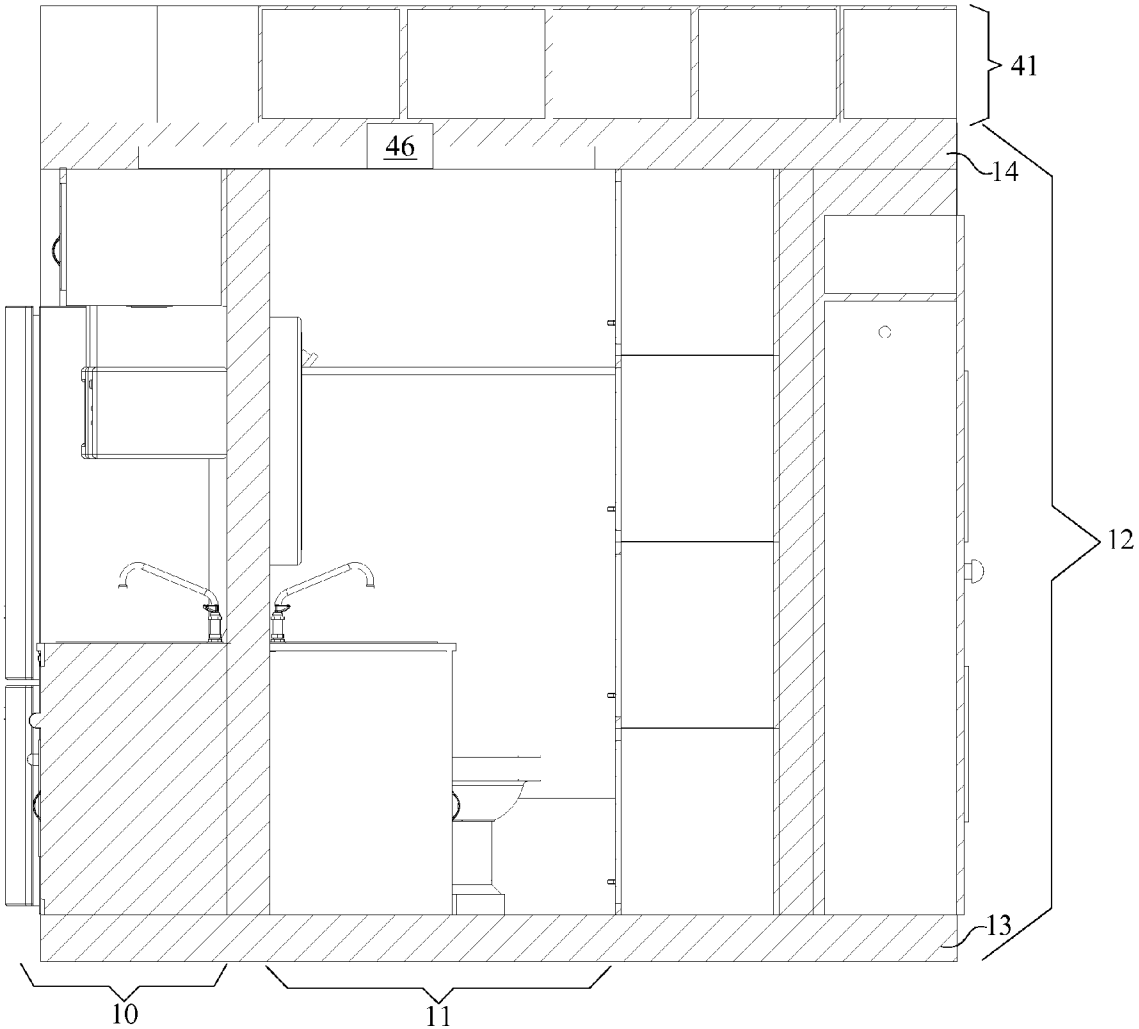
FIG. 11 is a front view of the amenities module through the line A-A in FIG. 3, showing the fluid communication of the HVAC system.

Further in accordance to the preferred embodiment of the present invention and FIG. 11, the present invention comprises a heating, ventilation, and cooling (HVAC) system 46 to adjust the temperature within the housing unit 1. The HVAC system 46 is integrated into the enclosure 12 in order to circulate air from around the housing unit 1 and within the enclosure 12. The HVAC system 46 is in fluid communication with the kitchen 10 and the bathroom 11 in order to force air into the surrounding area of the enclosure 12 from the after conditioning the air to the tenants preference. The HVAC system 46 is electrically connected to the electric source 5 through quick-connect electrical coupling 4 in order to power the HVAC unit to condition and force air through the HVAC system 46, as shown in FIG. 9.

In accordance to the preferred embodiment, the present invention further comprises a utility monitor and controller 47, shown in FIG. 6. The utility monitor and controller 47 assesses the usage of water and electricity by the housing unit 1 and monitors the temperature of the surround atmosphere to the housing unit 1. The utility monitor and controller 47 is mounted about the enclosure 12 such that it is easily accessible to the tenant. In accordance to FIG. 9, the utility monitor is electrically connected with the HVAC system 46 in order to receive a user input set point, or the desired temperature, which the HVAC system 46 seeks to achieve when heating or cooling the ambient air. In some embodiments, the utility monitor and controller 47 comprises a communications module, which allows the tenant or a landlord to remotely lock and unlock the housing unit 1, as well as a speaker and intercom such that the tenant is able to communicate to the entrance to the multi-dwelling housing unit 1 and to the landlord.

For safety, the preferred embodiment of the present invention includes a sprinkler system 48, shown in FIG. 4. The sprinkler system 48 is a fire emergency system which discharges water in the event 37 of a fire to assist in controlling or extinguishing the fire. The sprinkler system 48 is integrated into the ceiling 14 in order to be able to disperse water over an extensive area. In accordance to FIG. 8, the water source 6 is in fluid communication with the sprinkler system 48 through the water inlet coupling 28 such that water is discharged from the sprinkler system 48 into the enclosure 12.

Although the invention has been explained in relation to its preferred embodiment, it is to be understood that many other possible modifications and variations can be made without departing from the spirit and scope of the invention as hereinafter claimed.

What is claimed is:

1. A pre-fabricated module for multi-dwelling housing units comprises:

a housing unit;

an amenities module;

a plurality of quick-connect couplings;

a quick-connect electrical coupling;

the housing unit comprises an electric source, a water source, a sewage outlet, an at least one wall, and a floor;

the amenities module comprises a kitchen, a bathroom, and an enclosure;

the enclosure comprises a base, a ceiling, at least one solid lateral face, and at least one open lateral face;

the kitchen being peripherally positioned to the at least one open face, between the base and the ceiling;

the bathroom being internally positioned to the enclosure, between the base and the ceiling;

the amenities module being structurally connected to the housing unit through the at least one solid lateral face;

the amenities module being connected to the water source and the sewage outlet through the plurality of quick-connect couplings;

the amenities module being electrically connected to the electric source through the quick-connect electrical coupling;

the kitchen comprises a kitchen sink and a water heater;

the plurality of cabinets comprise a plurality of lower cabinets;

the plurality of quick-connect couplings comprise a water inlet coupling;

the water heater being mounted within a cabinet of the plurality of lower cabinets;

the water heater being positioned in between the kitchen sink and the base;

the water source being in fluid communication with the water heater through the water inlet coupling;

the water heater being in fluid communication with the kitchen sink; and the water heater being electrically connected to the electric source through the quick-connect electrical coupling.

2. The pre-fabricated module for multi-dwelling housing units, as claimed in claim 1, comprises:

the kitchen comprises a refrigerator, a kitchen sink, a microwave, a counter, a backing, and a plurality of cabinets;

the plurality of cabinets comprise a plurality of upper cabinets and a plurality of lower cabinets;

the backing being perpendicularly mounted to the base;

the plurality of upper cabinets being adjacently mounted to the backing;

the plurality of lower cabinets being adjacently mounted to the backing and the base;

the counter being positioned in between the plurality of lower cabinets and the plurality of upper cabinets;

the counter being adjacently mounted to the plurality of lower cabinets;

the kitchen sink being integrated into the counter; and the microwave being mounted to the plurality of upper cabinets, opposite of the ceiling.

3. The pre-fabricated module for multi-dwelling housing units, as claimed in claim 1, comprises:

the kitchen comprises a refrigerator and a kitchen sink;

the plurality of quick-connect couplings comprise a water inlet coupling and a sewage coupling;

the water source being in fluid communication with the refrigerator and the kitchen sink through the water inlet coupling; and the kitchen sink being in fluid communication with the sewage outlet through the sewage coupling.

4. The pre-fabricated module for multi-dwelling housing units, as claimed in claim 1, comprises:

the kitchen comprises a refrigerator and a microwave; and the refrigerator and the microwave being electrically connected to the electric source through the quick-connect electrical coupling.

5. The pre-fabricated module for multi-dwelling housing units, as claimed in claim 1, comprises:

the kitchen comprises a dishwasher and a counter;

the plurality of quick-connect couplings comprise a water inlet coupling and a sewage coupling;

the dishwasher being mounted to the base and positioned in between the base and the counter;

the water source being in fluid communication with the dishwasher through the water inlet coupling;

the dishwasher being in fluid communication with the sewage outlet through the sewage coupling; and the dishwasher being electrically connected to the electric source through the quick-connect electrical coupling.

6. The pre-fabricated module for multi-dwelling housing units, as claimed in claim 1, comprises:

the kitchen comprises an oven and a counter;

the oven being mounted to the base and positioned in between the base and the counter; and the oven being electrically connected to the electric source through the quick-connect electrical coupling.

7. The pre-fabricated module for multi-dwelling housing units, as claimed in claim 1, comprises:

the kitchen comprises a kitchen sink and a garbage disposal;

the plurality of cabinets comprise a plurality of lower cabinets;

the plurality of quick-connect couplings comprise a sewage coupling;

the garbage disposal being mounted within a cabinet of the plurality of lower cabinets;

the garbage disposal being positioned in between the kitchen sink and the base;

the kitchen sink being in fluid communication with the garbage disposal;

the garbage disposal being in fluid communication with the sewage outlet through the sewage coupling; and the garbage disposal being electrically connected to the electric source through the quick-connect electrical coupling.

8. The pre-fabricated module for multi-dwelling housing units, as claimed in claim 1, comprises:

the kitchen comprises a hide-away table;

the plurality of cabinets comprise a plurality of lower cabinets; and the hide-away table being integrated into the plurality of lower cabinets.

9. The pre-fabricated module for multi-dwelling housing units, as claimed in claim 1, comprises:

the bathroom comprises a light, a fan, a shower, a toilet, a bathroom sink, a vent, a bathroom sink cabinet, and a storage cabinet;

the shower, the toilet, the bathroom sink cabinet, and the storage cabinet being mounted to the base;

the bathroom sink being mounted to the bathroom sink cabinet;

the bathroom sink being oppositely positioned of the base; and the vent, the fan, and the light being integrated into the ceiling.

10. The pre-fabricated module for multi-dwelling housing units, as claimed in claim 1, comprises:

the bathroom comprises a shower, a toilet, and a bathroom sink;

the plurality of quick-connect couplings comprise a water coupling and a sewage coupling;

the water source being in fluid communication with the shower, the toilet, and the bathroom sink through the water inlet coupling; and the shower, the toilet, and the bathroom sink being in fluid communication with the sewage outlet through the sewage coupling.

11. The pre-fabricated module for multi-dwelling housing units, as claimed in claim 1, comprises:

the bathroom comprises a light and a fan; and the light and the fan being electrically connected to the electric source through the quick-connect electrical coupling.

12. The pre-fabricated module for multi-dwelling housing units, as claimed in claim 1, comprises:

a fold-down bed; and the fold-down bed being hingedly and externally mounted to the enclosure, adjacent to the base.

13. The pre-fabricated module for multi-dwelling housing units, as claimed in claim 1, comprises:

a loft; and the loft being externally positioned across the ceiling, opposite to the base.

14. The pre-fabricated module for multi-dwelling housing units, as claimed in claim 12, comprises:

a safety railing; and the safety railing being perimetrically mounted about the loft.

15. The pre-fabricated module for multi-dwelling housing units, as claimed in claim 1, comprises:

a laundry closet;

the laundry closet comprises a washing machine and a dryer;

the plurality of quick-connect couplings comprise a water inlet coupling and a sewage coupling;

the laundry closet being integrated into the enclosure;

the washing machine and the dryer being internally positioned within the laundry closet;

the water source being in fluid communication with the washing machine through the water inlet coupling;

the washing machine being in fluid communication with the sewage outlet through the sewage coupling; and the washing machine and the dryer being electrically connected to the electric source through the quick-connect electrical coupling.

16. The pre-fabricated module for multi-dwelling housing units, as claimed in claim 1, comprises:

a heating, ventilation, and cooling (HVAC) system;

the HVAC system being integrated into the enclosure;

the HVAC system being in fluid communication with the kitchen and the bathroom; and the HVAC system being electrically connected to the electric source through the quick-connect electrical coupling.

17. The pre-fabricated module for multi-dwelling housing units, as claimed in claim 15, comprises:

a utility monitor and controller;

the utility monitor and controller being mounted about the enclosure;

the utility monitor and controller being electrically connected with the HVAC system; and the utility monitor and controller being electrically connected to the electric sources through the quick-connect electrical coupling.

18. The pre-fabricated module for multi-dwelling housing units, as claimed in claim 1, comprises:

a sprinkler system;

the plurality of quick-connect couplings comprise a water inlet coupling;

the sprinkler system being integrated to the ceiling; and the water source being in fluid communication with the sprinkler system through the water inlet coupling.

* * * * *